US009593584B2

(12) United States Patent
Lehmann et al.

(10) Patent No.: US 9,593,584 B2
(45) Date of Patent: Mar. 14, 2017

(54) TURBINE ROTOR BLADE OF A GAS TURBINE

(71) Applicants: Rolls-Royce Deutschland Ltd & Co KG, Blankenfelde-Mahlow (DE); Rolls-Royce plc, London (GB)

(72) Inventors: Knut Lehmann, Berlin (DE); Manuel Herm, Berlin (DE)

(73) Assignees: Rolls-Royce plc, London (GB); Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 594 days.

(21) Appl. No.: 14/061,971

(22) Filed: Oct. 24, 2013

(65) Prior Publication Data

US 2014/0119942 A1 May 1, 2014

(30) Foreign Application Priority Data

Oct. 26, 2012 (GB) ..... 1219267.0
Oct. 31, 2012 (DE) ..... 10 2012 021 400

(51) Int. Cl.
*F01D 5/20* (2006.01)
*F01D 5/14* (2006.01)
*F01D 11/08* (2006.01)

(52) U.S. Cl.
CPC ..... *F01D 5/20* (2013.01); *F01D 5/141* (2013.01); *F01D 11/08* (2013.01); *F05D 2240/307* (2013.01)

(58) Field of Classification Search
CPC ... F01D 5/14; F01D 5/141; F01D 5/20; F01D 11/001; F01D 11/08; F05D 2240/125; F05D 2240/307
See application file for complete search history.

(56) References Cited

U.S. PATENT DOCUMENTS 711,832 A 10/1902 Denison
1,955,929 A 4/1934 Hans et al.
4,424,001 A * 1/1984 North ..... F01D 5/20 415/115

(Continued)

FOREIGN PATENT DOCUMENTS

CN 101255800 9/2008
CN 101255873 9/2008

(Continued)

OTHER PUBLICATIONS

German Search Report Apr. 29, 2013 from counterpart German App No. 102012021400.6.

(Continued)

*Primary Examiner* — Dwayne J White
*Assistant Examiner* — Christopher R Legendre
(74) *Attorney, Agent, or Firm* — Timothy J. Klima; Shuttleworth & Ingersoll, PLC

(57) ABSTRACT

The present invention relates to a turbine rotor blade of a gas turbine with a blade tip, said blade tip having at least on its suction side, extending from a stagnation point on the blade leading edge to an intersection point of the suction-side profile line of the blade with a trailing-edge circle, an overhang which is substantially zero at the stagnation point and at the intersection point and which has a maximum value at around 40% of the running length of the suction-side overhang.

20 Claims, 6 Drawing Sheets

(56) References Cited

U.S. PATENT DOCUMENTS

Figure 1:
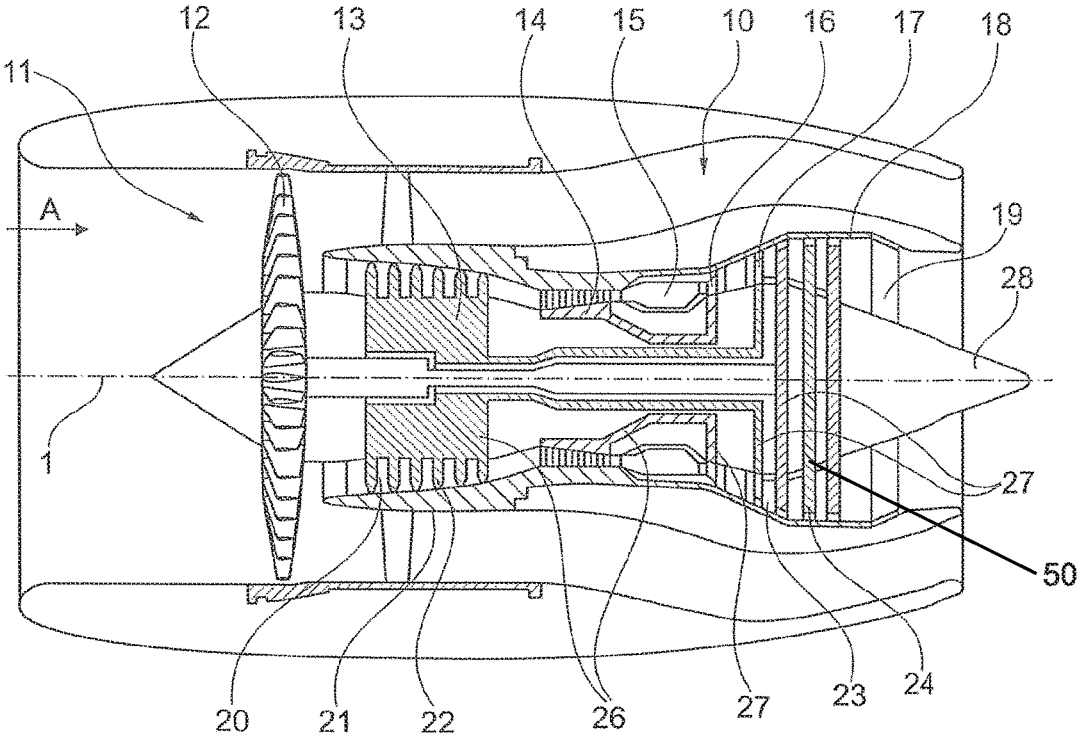

| | | | | |
|---|---|---|---|---|
| 4,761,116 | A * | 8/1988 | Braddy | F01D 5/20 415/115 |
| 5,503,527 | A | 4/1996 | Lee et al. | |
| 6,142,739 | A | 11/2000 | Harvey | |
| 6,422,821 | B1 | 7/2002 | Lee et al. | |
| 7,118,329 | B2 | 10/2006 | Goodman | |
| 7,351,035 | B2 | 4/2008 | Deschamps et al. | |
| 7,632,062 | B2 * | 12/2009 | Harvey | F01D 5/20 415/115 |
| 7,641,446 | B2 | 1/2010 | Harvey | |
| 7,740,445 | B1 | 6/2010 | Liang | |
| 8,133,032 | B2 * | 3/2012 | Tibbott | F01D 11/08 416/235 |
| 8,246,307 | B2 * | 8/2012 | Cheong | F01D 5/20 415/115 |
| 8,632,311 | B2 * | 1/2014 | Klasing | F01D 5/20 415/173.4 |
| 8,845,280 | B2 * | 9/2014 | Diamond | F01D 5/20 415/168.2 |
| 8,851,833 | B2 * | 10/2014 | Diamond | F01D 5/20 415/168.2 |
| 8,944,774 | B2 * | 2/2015 | Bielek | F01D 5/145 416/236 A |
| 2007/0237627 | A1 * | 10/2007 | Bunker | F01D 5/145 415/170.1 |
| 2009/0180887 | A1 * | 7/2009 | Mischo | F01D 5/20 416/223 R |
| 2010/0054955 | A1 | 3/2010 | Helvaci et al. | |
| 2010/0098554 | A1 | 4/2010 | Cheong et al. | |
| 2010/0221122 | A1 | 9/2010 | Klasing et al. | |
| 2011/0255986 | A1 | 10/2011 | Diamond et al. | |
| 2011/0255990 | A1 * | 10/2011 | Diamond | F01D 5/20 416/97 R |
| 2014/0119920 | A1 * | 5/2014 | Coull | F01D 5/20 416/182 |
| 2014/0119942 | A1 * | 5/2014 | Lehmann | F01D 5/20 416/241 R |
| 2014/0241899 | A1 | 8/2014 | Marini et al. | |
| 2015/0110617 | A1 | 4/2015 | Stein et al. | |
| 2015/0159488 | A1 * | 6/2015 | Lehmann | F01D 5/18 416/1 |

FOREIGN PATENT DOCUMENTS

| | | |
|---|---|---|
| DE | 69515442 | 10/2000 |
| DE | 60211963 | 1/2007 |
| EP | 1898052 | 3/2008 |
| GB | 793143 | 4/1958 |
| GB | 1366024 | 9/1974 |
| GB | 1491556 | 11/1977 |
| WO | 2005/106207 | 11/2005 |

OTHER PUBLICATIONS

European Search Report dated Nov. 27, 2013 for counterpart European Patent Application No. 13190022.7.

European Search Report dated Nov. 27, 2013 for counterpart European Patent Application No. 13190039.1.

British Search Report dated Feb. 21, 2013 issued in counterpart Application No. 1219267.0.

* cited by examiner

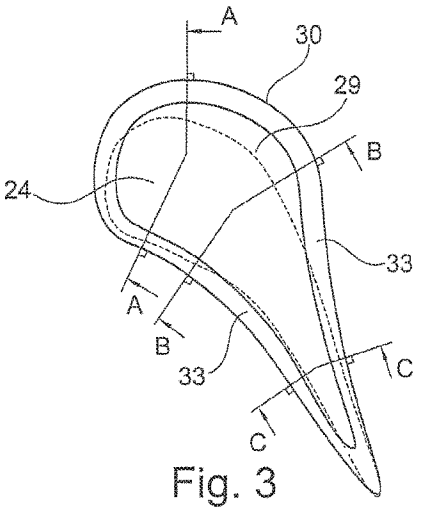
Fig. 3
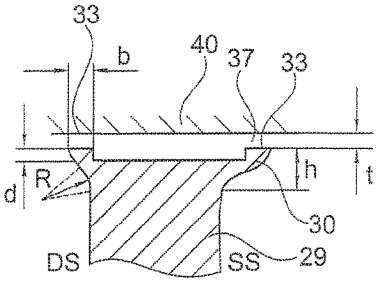
Section B:B
Fig. 7
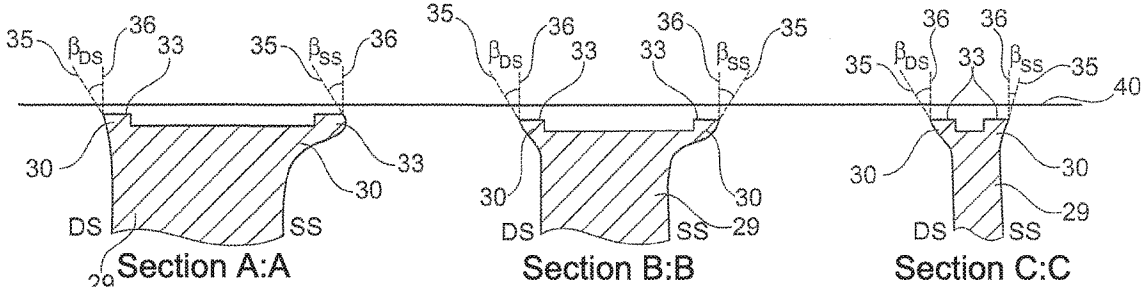
Section A:A
Fig. 4
Section B:B
Fig. 5
Section C:C
Fig. 6

TURBINE ROTOR BLADE OF A GAS TURBINE

This application claims priority to GB Patent Application 1219267.0 filed Oct. 26, 2012 and German Patent Application 102012021400.6 filed Oct. 31, 2012. The entirety of both applications are incorporated by reference herein.

This invention relates to a turbine rotor blade of a gas turbine with a blade profile extending in the radial direction (relative to an engine axis of the gas turbine) or in the longitudinal direction of the blade, and with a blade tip. The radially outer end of the turbine rotor blade is designated as the blade tip in connection with the present invention.

The invention furthermore not only relates to rotor blades, but also to stator vanes, with the vane tip, in the case of stator vanes, being defined as the radially inner end of the vane.

It is known from the state of the art that a leakage mass flow driven by the pressure difference from the blade pressure side to the blade suction side arises at the radial gap between the rotor blades and a casing, or between stator vanes and a hub. Solutions have been proposed that reduce this leakage mass flow and/or reduce the negative effect of a forming blade tip swirl on the turbine aerodynamics.

To improve the flow over the blade tips of the rotors, it is mainly circumferential sealing edges (squealers), but also in some cases overhangs at the blade tip (winglet design) that are provided. Squealer designs (US 2010/0098554 A1) achieve however only a minor improvement of the aerodynamics. The winglet design in accordance with U.S. Pat. No. 7,118,329 B2 has an overhang towards the pressure side close to the blade trailing edge and a circumferential sealing edge at the blade tip with an opening at the blade trailing edge. The design in accordance with U.S. Pat. No. 6,142,739 has a suction-side and a pressure-side overhang which is very small close to the blade leading edge and overhangs further and further along the blade skeleton line up to the blade trailing edge. Furthermore, this design has an opening of the blade tip cavity on the trailing edge.

The solutions known from the state of the art result on the one hand in only minor aerodynamic advantages, on the other hand the overhangs (winglets) are dimensioned such that they can be poorly supported in particular by the thin blade trailing edge and impair the mechanical strength of the blade.

The object underlying the present invention is to provide a turbine rotor blade of the type specified at the beginning, which, while being simply designed and easily and cost-effectively producible, enables optimization of the leakage mass flow and features a good component strength.

It is a particular object to provide solution to the above problem by a combination of the features described herein. Further advantageous embodiments will become apparent from the present description.

It is thus provided in accordance with the invention that the blade tip, at least on its suction side, extending from a stagnation point on the blade leading edge to an intersection point of the suction-side profile line of the blade with a trailing-edge circle, has an overhang (winglet). At the stagnation point and at the intersection point with the trailing-edge circle, the overhang has a value, which is substantially zero and reaches its maximum at around 40% of the running length of the suction-side profile line.

In accordance with the invention, therefore, a flow-optimized structure advantageous with regard to the strength of the blade is created in which the aerodynamic losses are minimized.

It is particularly favourable when the size of the overhang on the suction side (vertical distance from the suction-side profile line) attains about 45% of the diameter of the maximum circle $T_{max}$ that can be inscribed in the blade profile.

In a particularly favourable embodiment of the blade in accordance with the invention, it is furthermore provided that the blade tip on its suction side, extending from a stagnation point on the blade leading edge to an intersection point of the suction-side profile line of the blade with the trailing-edge circle, also has an overhang (winglet) which is substantially zero at the stagnation point and at the intersection point and which has a maximum value at a running length of around 20% to 60% of the total running length of the suction-side profile line.

For improvement of the flow and for further reduction of the leakage mass flow, it can furthermore be favourable that at the radially outer rim area of the blade (in the case of a rotor blade) or at the radially inner rim area in the case of a stator vane a circumferential sealing edge is provided. This can for example have a substantially rectangular cross-section such that a depression/cavity is formed in the central area of the blade tip.

The sealing edge can furthermore preferably have an area with a reduced height or an area with a height of zero provided in the area of the suction-side overhang between a running length of the suction-side profile line from 10% to 30%. As a result, an opening is formed through which an inflow is possible of the boundary layer close to the casing onto the blade tip.

It is particularly advantageous to dimension the height and the width of the sealing edge depending on a blade tip gap. The radial height can here be between half of the blade tip gap and three times the blade tip gap. With regard to the width of the sealing edge, it can be designed between three times the blade tip gap and six times the blade tip gap.

With regard to the height of the overhang (winglet) in the radial direction, it can be particularly favourable when this height amounts to a maximum of 10% of the radial length of the blade profile. A preferred value is 5%. This means that about 90% to 95% of the blade profile is designed unchanged and that only the outer 10 or 5% of the length of the blade profile is provided with the overhang or winglet in accordance with the invention.

To further optimize the flow conditions, it can be favourable to design the transition from the blade profile to the overhang (winglet) in rounded form.

It can furthermore be advantageous to provide the edge area of the overhang (winglet) with an angle at the radial end. This angle is defined in a plane extended by a radial vector from the sealing edge to the engine axis and by a vector perpendicular to the sealing edge. The angle is then formed between a tangent on the outer sealing edge surface and the radial vector. It is particularly favourable here when the tangent is directed away from the blade at an angle between 10° and 50° on the pressure-side sealing edge of the blade, and directed towards the blade with a running length of $0.1 \leq s \leq 0.3$ at an angle of 10° to 50° and away from the blade with a running length of $0.4 \leq s \leq 1$ at an angle of 10° to 50° on the suction-side sealing edge.

The winglet design in accordance with the invention has the property of improving the flow over the turbine blade tips such that the leakage mass flow over the blade tip is reduced (efficiency improvement in the rotor) and at the same time the outflow in the area of the rotor blade tip is made uniform in respect of the outflow angle (efficiency improvement in the downstream blade rows). These advantages are achieved by the following flow-mechanical effects:

By the relatively rapid decrease in the large suction-side overhang in the area (b) a concave blade tip shape is obtained. This leads to the blade tip swirl gaining an increasingly large distance from the blade downstream.

As a result, the blade tip swirl is decoupled from the suction-side flow around the blade and interacts very little or not at all with the secondary flow swirl developing in this area. This decoupling contributes decisively to efficiency improvement in the blade tip flow by the winglet.

The overhang of the winglet reduces the driving pressure gradient between pressure side and suction side and hence reduces the leakage mass flow.

The opening of the circumferential sealing edge of the winglet ensures an inflow of relatively cold air close to the casing into the cavity of the winglet. The trajectory of this inflow (flow line curvature) creates a pressure gradient in the direction of the pressure side of the blade. This achieves a further reduction of the leakage mass flow, Furthermore, the inflowing relatively cold air reduces the cooling requirements for the winglet.

The shape (tangent angle) of the circumferential or interrupted sealing edge is designed depending on the profile running length such that flow separations are caused at required positions (e.g. pressure side) and flow separations are prevented at other positions (e.g. suction side).

Figure 9:
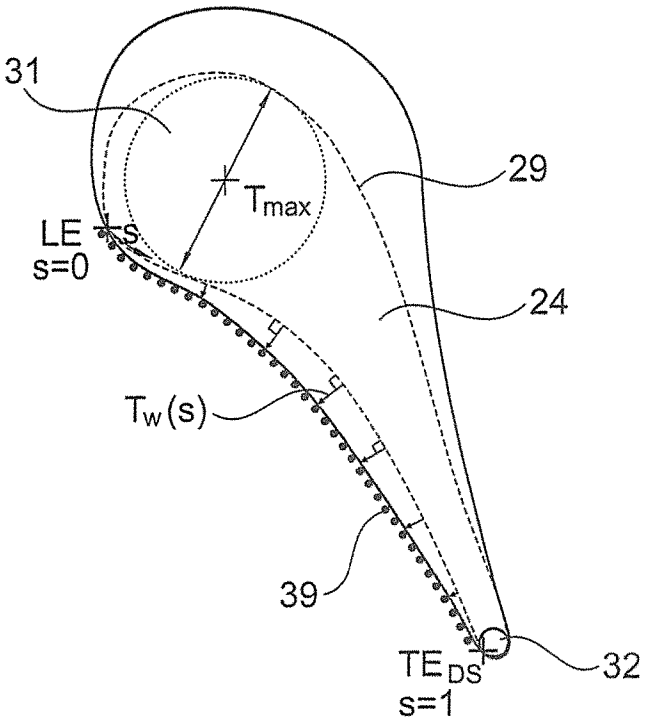
Figure 8:
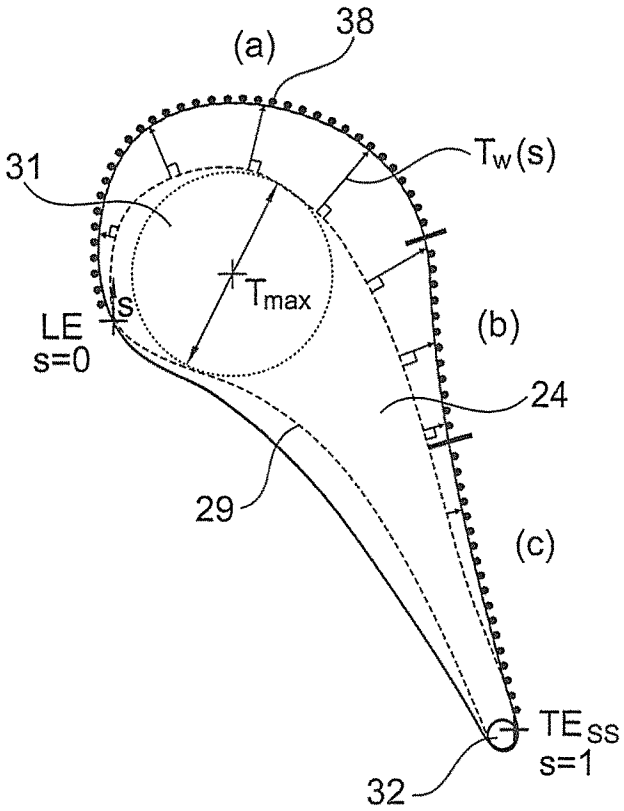
Figure 10:
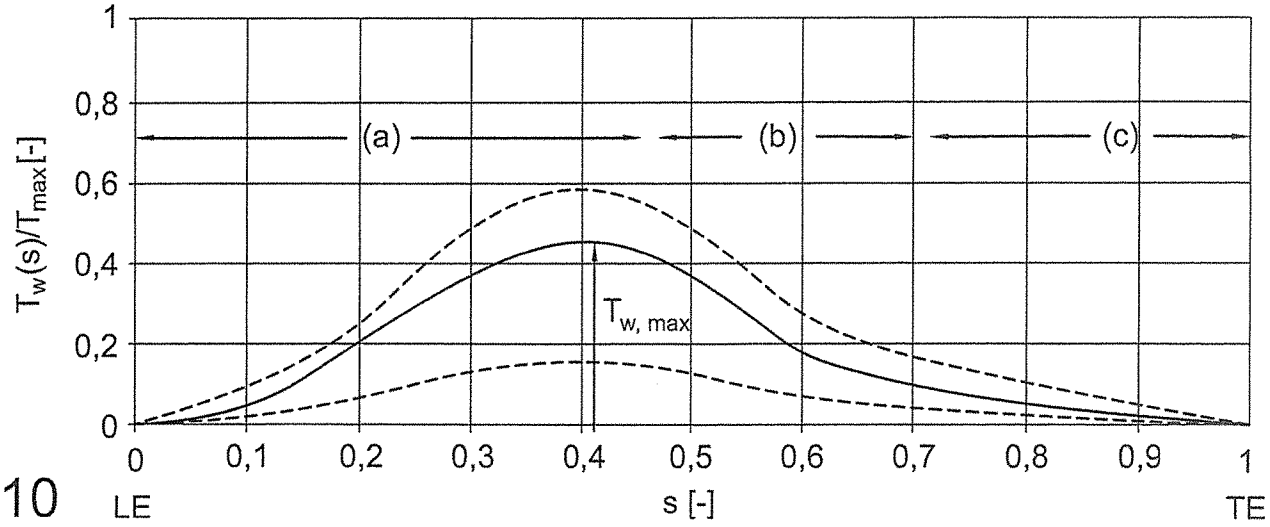
Figure 11:
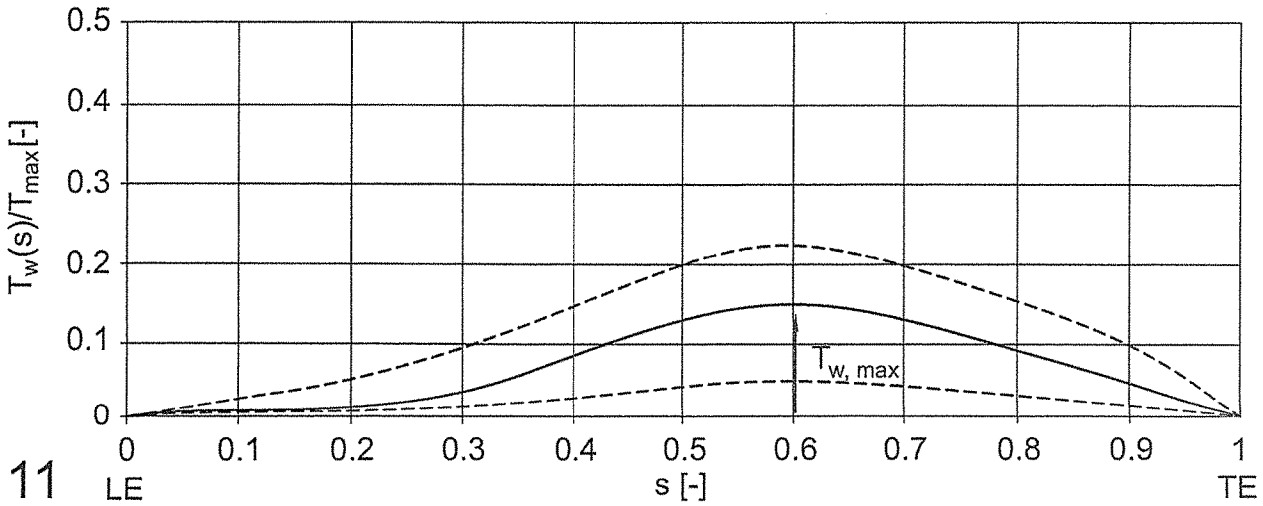
Figure 13:
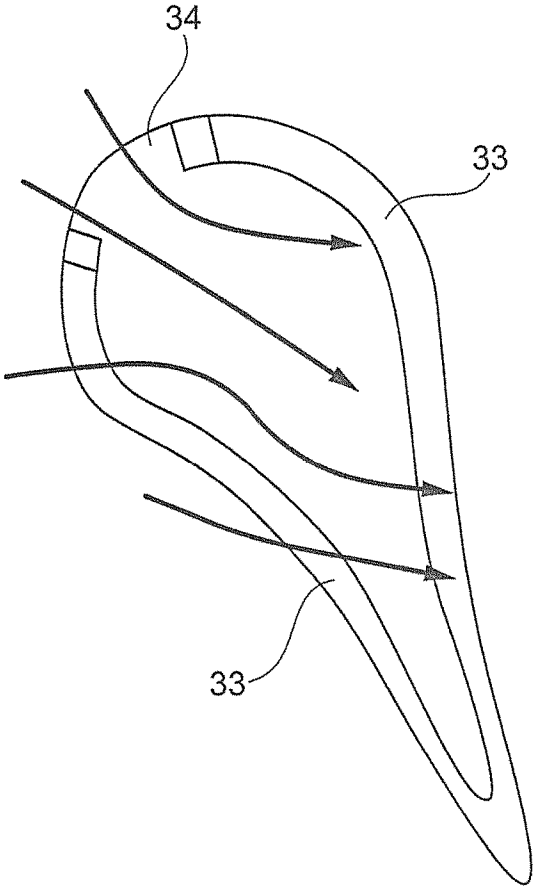
Figure 12:
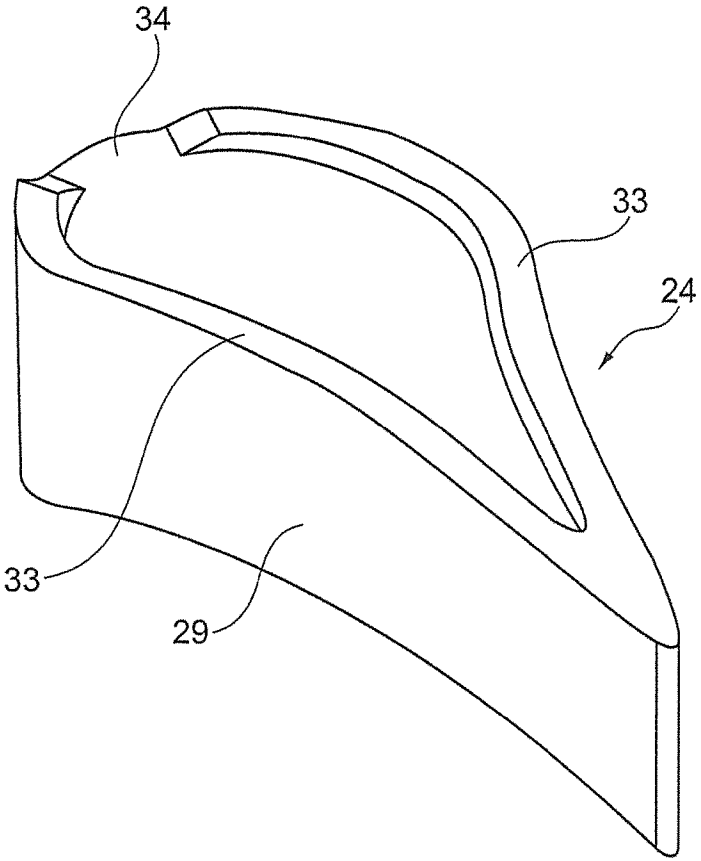
Figure 15:
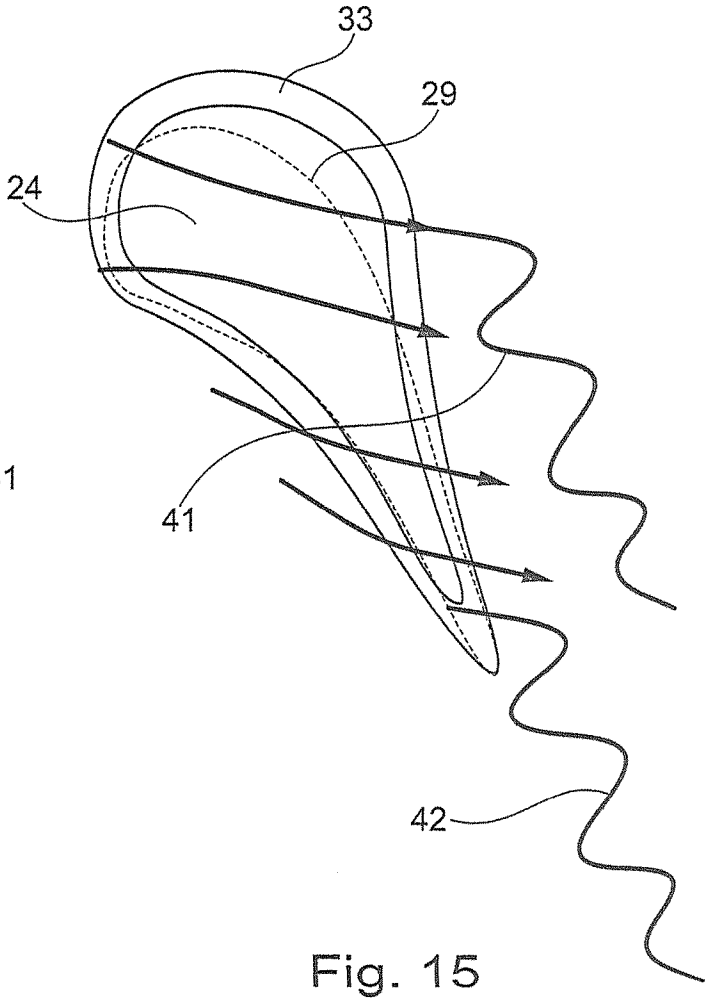
Figure 14:
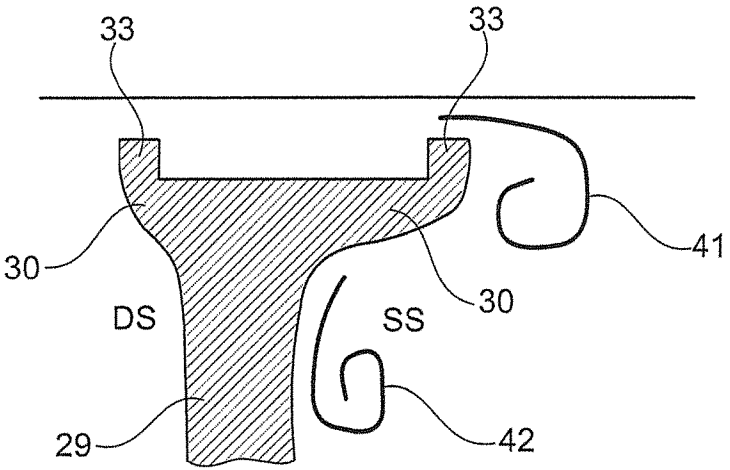

The invention is explained in the following in light of the accompanying drawing showing an exemplary embodiment. In the drawing, FIG. 1 shows a schematic representation of a gas-turbine engine in accordance with the present invention, FIG. 2 shows a simplified top view onto the end area of the blade in accordance with the present invention, FIG. 3 shows view, by analogy with FIG. 2, indicating the sectional lines of FIGS. 4 to 6, FIGS. 4 to 6 show partial sections along the sectional lines in FIG. 3, FIG. 7 shows a representation similar to FIG. 5, indicating the definitions for dimensioning the blade end area, FIGS. 8, 9 show front-side views, by analogy with FIGS. 2 and 3, representing the overhang in accordance with the present invention, FIGS. 10, 11 show thickness distributions of the suction-side and pressure-side overhang with reference to the running length of the suction-side and/or pressure-side profile line, FIG. 12 shows a perspective front-side view, by analogy with FIGS. 2 and 3, representing the sealing edge, FIG. 13 shows a top view onto the representation as per FIG. 12 with flow lines, FIG. 14 shows a sectional view by analogy with FIGS. 4 to 6, representing the flow curve, and FIG. 15 shows a top view illustrating the flow curve shown in FIG. 14.

Figure 2:
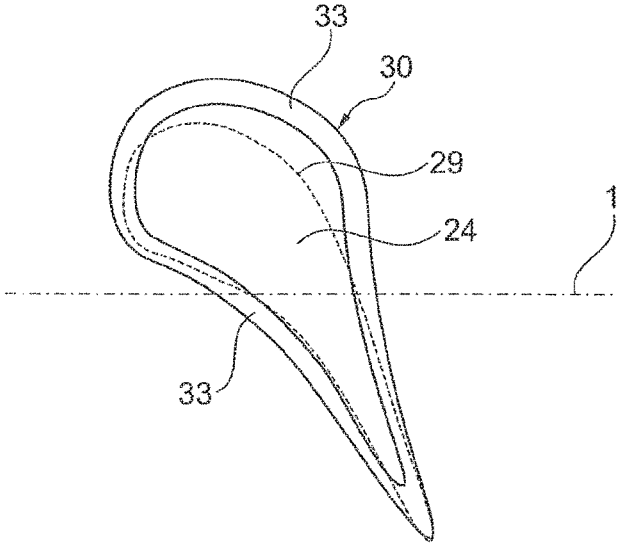

The gas-turbine engine 10 in accordance with FIG. 1 is a generally illustrated example of a turbomachine where the invention can be used. The engine 10 is of conventional design and includes in the flow direction, one behind the other, an air inlet 11, a fan 12 rotating inside a casing, an intermediate-pressure compressor 13, a high-pressure compressor 14, a combustion chamber 15, a high-pressure turbine 16, an intermediate-pressure turbine 17 and a low-pressure turbine 18 as well as an exhaust nozzle 19, all of which being arranged about a central engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of fixed stator vanes 23 projecting radially inwards from the casing 21 into the annular flow duct through the turbines 16, 17, 18, and a subsequent arrangement of turbine rotor blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

FIG. 2 shows a front view of an exemplary embodiment of a turbine rotor blade 24 in accordance with the invention. It us understood that the front face is not flat, but part of a cylinder surface around the engine axis 1. To simplify the illustration, the end face is shown flat in each of the following figures.

FIG. 2 thus shows in a top view the rotor blade tip shape in accordance with the invention. In this case one feature of the invention is the specific shape of the suction-side overhang 30. The shape in accordance with the invention of the suction-side overhang 30 is described in more detail using FIGS. 8 and 10. Two reference points, i.e. the stagnation point on the blade leading edge (under 2D inflow) LE and the intersection point of the suction-side profile line with the trailing-edge circle TE, are used for describing the suction-side winglet overhang. Between these two reference points, the dimension-less running length s along the suction-side profile line is defined, so that s(LE)=0 and s(TE)=1 apply. Along s, the winglet overhang $T_w(s)$ is defined as the thickness distribution, i.e. as the vertical distance from the suction-side blade profile line. The thickness distribution is here made dimension-less with the maximum profile thickness $T_{max}$ of the blade tip (diameter of the largest circle 31 that can be inscribed in the blade profile).

The thickness distribution in FIG. 10 is particularly advantageous to make use of the aerodynamic effects of the suction-side overhang 30. At the two reference points LE and TE, the thickness distribution is close to 0 (no significant overhang 30 present). Starting from point LE, the overhang 30 increases along s initially only very slightly. From approx. s=0.1, the thickness distribution, area (a), rapidly increases to a maximum Tw, max, which is reached at approx. 40% of the running length s=0.4, or approximately in the area of the narrowest cross-section (throat) of the blade passage 50 (FIG. 1) between adjacent blades. Between approx. 0.5<=s <=0.7, area (b), the thickness distribution decreases rapidly to approx. 20% of Tw, max and finally reverts slowly to 0% at s=1, area (c). Furthermore, FIG. 10 shows two further thickness distributions (dashed lines) which thus delimit an area for the particularly advantageous design of the suction-side overhang 30.

in FIGS. 8 and 9, a blade profile 29 is drawn as a dashed line, with this line corresponding to the blade profile under the overhang (winglet) 30 at 90% of the blade height. The line 38 shows the contour of the suction-side overhang (FIG. 8), while the line 39 shows the contour of the pressure-side overhang (FIG. 9). The reference numeral 31 indicates the circle which can be inscribed inside the area of maximum cross-sectional thickness of the blade profile 29. The reference numeral 32 shows the trailing-edge circle.

As shown in FIGS. 2 and 3, the rim of the overhang 30 is designed in the form of a sealing edge 33 which is designed substantially circumferential. It has, as is described in the following, an opening 34 (FIGS. 12 and 13). While FIG. 8 shows and explains the suction-side overhang in detail, FIG. 9 shows the pressure-side overhang with its contour 39.

FIGS. 4 to 7 each show sectional views along the sectional lines shown in FIG. 3.

The thickness curves of the overhangs on the suction side and on the pressure side are shown in FIGS. 10 and 11 respectively. These curves are plotted over a dimension-less running length s which extends from the stagnation point on the blade leading edge LE along the suction-side or pressure-side profile line up to the intersection point of the profile line with the trailing-edge circle TE. The size of the overhang $T_w(s)$ is standardized to the diameter of the maximum circle $T_{max}$ which can be inscribed in the blade profile. The result shows at which points the maximum values are particularly favourable. The dashed lines in FIGS. 10 and 11 show a preferred dimensioning range, while the continuous line represents an optimized solution.

The rotor blade tip has, as shown in the Figures, the following preferred design properties for minimizing the effect of the rotor tip gap leakage flow on the turbine efficiency:

- A relatively small but significant pressure-side overhang $T_w(s)$, which, as shown in FIGS. 9 and 11, is very small between $0 \leq s \leq 0.2$, grows from s=0.2 to s=0.6 up to its maximum of 15% $T_{max}$ and finally drops from s=0.6 up to the blade trailing edge, so that the pressure-side overhang at s=1 merges tangentially at the trailing-edge circle. A favourable design of the pressure-side overhang can be delimited by means of the dashed curves in FIG. 11.
- An opening, at least however a reduction in the height d of the circumferential sealing edge in the front area of the suction-side overhang between approx. s=0.1 and s=0.3, as shown in FIGS. 12 and 13.
- A height d, defined by means of the rotor blade tip gap (nominally in normal operation) t, of the circumferential or interrupted sealing edge on the winglet, of approx. $0.5t \leq d \leq 3t$ (see FIG. 7).
- A width b, defined by means of the rotor blade tip gap t, of the circumferential or interrupted sealing edge on the winglet, of approx. $3t \leq b \leq 6t$ (see FIG. 7).
- A height h of the winglet of not more than 10% of the mean height of the rotor blade profile. In a particularly favourable embodiment, h should be ~5% of the mean height of the rotor blade profile (see FIG. 7). Here, h must be regarded as the radial distance of the winglet tip from the radial blade profile section at which the widening of the blade profile into the winglet clearly begins.
- A steady and gentle transition, rounded with appropriate radii R (or suitable curve shapes), between the winglet overhang and the blade profile (see FIG. 7).
- An angle β dependent on the profile running length s and by way of example defined by the blade sections A:A, B:B and C:C in FIG. 7 between the tangent on the outer sealing edge 35 and the radial vector 36, so that the tangent is always directed away from the blade at an angle between $10° \leq \beta_{DS} \leq 50°$ on the pressure side, and the tangent is directed towards the blade between $0.1 \leq s \leq 0.3$ at an angle of $10° \leq \beta_{SS} \leq 50°$, but always away from the blade between $0.4 \leq s \leq 1$ at an angle of $10° \leq \beta_{SS} \leq 50°$ on the suction side.

To clarify the above statements, FIGS. 4 to 6 thus each show sectional views in accordance with FIG. 3, from which the preferred embodiments result. In particular, FIGS. 4 to 6 show the respective angles β between the tangent 35 and the radial vector 36. FIG. 7 again makes clear the dimensional definitions and additionally represents in schematic form the casing 40 and the blade tip gap 37.

FIGS. 12 to 15 again show a representation of the flow conditions. FIG. 13 shows here in particular an inflow through the opening 34 and a flow through the blade tip gap 37. Correspondingly, FIGS. 14 and 15 show for clarity an example of a forming blade tip gap swirl 41 and of a secondary flow swirl 42.

LIST OF REFERENCE NUMERALS

1 Engine axis
10 Gas-turbine engine core engine
11 Air inlet
12 Fan
13 Intermediate-pressure compressor (compressor)
14 High-pressure compressor
15 Combustion chambers
16 High-pressure turbine
17 Intermediate-pressure turbine
18 Low-pressure turbine
19 Exhaust nozzle
20 Guide vanes
21 Engine casing
22 Compressor rotor blades
23 Stator vanes
24 Turbine rotor blades
26 Compressor drum or disk
27 Turbine rotor hub
28 Exhaust cone
29 Blade profile (below the winglet at approx. 90% of blade height)
30 Overhang/winglet
31 Circle (with max. diameter that can be inscribed in the blade pro e
32 Trailing-edge circle
33 Sealing edge
34 Opening of sealing edge
35 Tangent on sealing edge
36 Radial vector on sealing edge
37 Blade tip gap
38 Contour of suction-side overhang
39 Contour of pressure-side overhang
40 Casing end wall of turbine rotor
41 Blade tip gap swirl
42 Secondary flow swirl.
DS Pressure side
SS Suction side
LE Stagnation point on blade leading edge
TE Intersection point of suction-side and/or pressure-side profile line with the trailing-edge circle
b Width of sealing edge
d Height of sealing edge
h Height of overhang (winglet)
R Fillet radii between overhang (winglet) and blade profile
s Running length
t Height of blade tip gap
$T_{max}$ Max. blade profile thickness
$T_w$ Size of overhang (winglet)
$T_{w,max}$ Max. size of overhang (winglet)

What is claimed is:

1. A turbine rotor blade of a gas turbine, comprising:

a blade profile having a pressure side, a suction side, a leading edge and a trailing edge;

a blade tip at a radially outer end of the blade profile, said blade tip including an overhang positioned on at least the suction side, the suction-side overhang extending between a stagnation point on the blade leading edge to a first intersection point of a suction side profile line of the blade with a trailing-edge circle, the suction-side overhang being substantially zero at the stagnation point and at the first intersection point and having a maximum thickness at between 35% to 45% of a first running length along the suction side surface from the stagnation point to the first intersection point of the suction side profile line;

the suction-side overhang decreasing to less than 50% of the maximum thickness between 50% to 70% of the first running length.

2. A turbine rotor of a gas turbine, comprising a plurality of blades in accordance with claim 1 positioned circumferentially around a rotor hub to form a blade passage between each pair of adjacent blades, wherein the maximum thickness of the suction-side overhang is positioned substantially in a region of a narrowest cross-section of the blade passage.

3. The blade in accordance with claim 1, wherein the blade tip includes on the pressure side, extending from the stagnation point on the blade leading edge to a second intersection point of a pressure-side profile line of the blade with the trailing-edge circle, a pressure-point overhang which is substantially zero at the stagnation point and at the second intersection point and which has a maximum thickness between 20% to 60% of a second running length along the pressure side surface from the stagnation point to the second intersection point of the pressure-side profile line of the blade.

4. The blade in accordance with claim 3, and further comprising a circumferential sealing edge at a radially outer edge area of the blade.

5. The blade in accordance with claim 4, wherein the sealing edge in a region of the suction side overhang has at least one chosen from a reduced height and a zero height positioned between 10% and 30% of the first running length.

6. The blade in accordance with claim 5, wherein the at least one chosen from a reduced height and a zero height forms an opening in the sealing edge.

7. The blade in accordance with claim 5, wherein a height of at least one chosen from the suction-side overhang and the pressure-side overhang is at most 10% of a radial length of the blade profile.

8. The blade in accordance with claim 5, wherein a transition from the blade profile to at least one chosen from the suction-side overhang and the pressure-side overhang is rounded.

9. The blade in accordance with claim 5, wherein, on the pressure side, a first portion of an outer edge of the pressure-side overhang flares away from an interior direction of the blade such that radially outward of the blade, a first tangent to the first portion extends away from the interior direction of the blade, the first tangent forming an angle of 10° to 50° with a first vector running in a first radial direction relative to an engine axis;

on the suction side, a second portion of an outer edge of the suction-side overhang tapers toward the interior direction of the blade between 10% and 30% of the first running length such that radially outward of the blade, a second tangent to the second portion extends toward the interior direction of the blade, the second tangent forming an angle of 10° to 50° with a second vector running in a second radial direction relative to the engine axis; and a third portion of the outer edge of the suction-side overhang flares away from the interior direction of the blade between 40% and 100% of the first running length such that radially outward of the blade a third tangent to the third portion extends away from the interior direction of the blade, the third tangent forming an angle of 10° to 50° with a third vector running in a third radial direction relative to the engine axis.

10. The blade in accordance with claim 5, wherein the height of at least one chosen from the suction-side overhang and the pressure-side overhang is at most 5% of a radial length of the blade profile.

11. The blade in accordance with claim 4, wherein, where "t" is a blade tip gap in operation, the blade has at least one chosen from the sealing edge having a radial height of 0.5 t to 3 t and the sealing edge having a width of 3 t to 6 t.

12. The blade in accordance with claim 1, wherein the suction side overhang decreases to approximately 20% of the maximum thickness between 50% to 70% of the first running length.

13. The blade in accordance with claim 12, wherein the suction side overhang has a maximum thickness at approximately 40% of the first running length.

14. The blade in accordance with claim 1, wherein the suction side overhang has a maximum thickness at approximately 40% of the first running length.

15. The blade in accordance with claim 1, wherein the blade tip includes on the pressure side, extending from the stagnation point on the blade leading edge to a second intersection point of a pressure-side profile line of the blade with the trailing-edge circle, a pressure-side overhang which is substantially zero at the stagnation point and at the second intersection point and which has a maximum thickness between 20% to 60% of a second running length along the pressure side surface from the stagnation point to the second intersection point of the pressure-side profile line of the blade.

16. The blade in accordance with claim 1, and further comprising a circumferential sealing edge at a radially outer edge area of the blade.

17. The blade in accordance with claim 16, wherein the sealing edge in a region of the suction side overhang has at least one chosen from a reduced height and a zero height positioned between 10% and 30% of the first running length.

18. The blade in accordance with claim 16, wherein, where "t" is a blade tip gap in operation, the blade has at least one chosen from the sealing edge having a radial height of 0.5 t to 3 t and the sealing edge having a width of 3 t to 6 t.

19. The blade in accordance with claim 16, wherein a height of at least one chosen from the suction-side overhang and the pressure-side overhang is at most 10% of a radial length of the blade profile.

20. The blade in accordance with claim 1, wherein, on the pressure side, a first portion of an outer edge of the pressure-side overhang flares away from an interior direction of the blade such that radially outward of the blade, a first tangent to the first portion extends away from the interior direction of the blade, the first tangent forming an angle of 10° to 50° with a first vector running in a first radial direction relative to an engine axis;

on the suction side, a second portion of an outer edge of the suction-side overhang tapers toward the interior direction of the blade between 10% and 30% of the first running length such that radially outward of the blade, a second tangent to the second portion extends toward the interior direction of the blade, the second tangent forming an angle of 10° to 50° with a second vector running in a second radial direction relative to the engine axis; and a third portion of the outer edge of the suction-side overhang flares away from the interior direction of the blade between 40% and 100% of the first running length such that radially outward of the blade a third tangent to the third portion extends away from the interior direction of the blade, the third tangent forming an angle of 10° to 50° with a third vector running in a third radial direction relative to the engine axis.

* * * * *